US011346157B2

(12) United States Patent
Linde et al.

(10) Patent No.: US 11,346,157 B2
(45) Date of Patent: May 31, 2022

(54) ABRASIVE SUSPENSION ERODING SYSTEM

(71) Applicant: ANT Applied New Technologies AG, Lübeck (DE)

(72) Inventors: Marco Linde, Lübeck (DE); Svein H. Sølversen, Tau (NO)

(73) Assignee: ANT Applied New Technologies AG, Lübeck (DE)

( * ) Notice: Subject to any disclaimer, the term of this patent is extended or adjusted under 35 U.S.C. 154(b) by 0 days.

(21) Appl. No.: 16/616,789

(22) PCT Filed: May 26, 2017

(86) PCT No.: PCT/EP2017/062751
§ 371 (c)(1),
(2) Date: Nov. 25, 2019

(87) PCT Pub. No.: WO2018/215074
PCT Pub. Date: Nov. 29, 2018

(65) Prior Publication Data
US 2020/0080383 A1 Mar. 12, 2020

(51) Int. Cl.
*E21B 7/18* (2006.01)
*E21B 29/12* (2006.01)
*B24C 3/32* (2006.01)

(52) U.S. Cl.
CPC ..... *E21B 7/185* (2013.01); *E21B 29/12* (2013.01); *B24C 3/325* (2013.01)

(58) Field of Classification Search
CPC ..... E21B 7/185; E21B 29/12; B24C 3/325
See application file for complete search history.

(56) References Cited

U.S. PATENT DOCUMENTS 4,534,427 A * 8/1985 Wang ..... B26F 3/004 175/67
5,381,631 A * 1/1995 Raghavan ..... B24C 1/045 166/298
7,540,327 B2 * 6/2009 Billingham ..... E21B 41/00 166/223
8,757,269 B2 * 6/2014 Tabor ..... E21B 29/12 166/340
2005/0173123 A1 * 8/2005 Lund ..... E02D 9/005 166/361
2012/0118562 A1 * 5/2012 McAfee ..... E21B 43/114 166/222
2013/0284440 A1 * 10/2013 McAfee ..... E21B 43/114 166/298

FOREIGN PATENT DOCUMENTS

GB 2359037 A * 8/2001 ..... B24C 1/045
WO 2015124182 A1 8/2015

* cited by examiner

*Primary Examiner* — Matthew R Buck
(74) *Attorney, Agent, or Firm* — McGlew and Tuttle, P.C.

(57) ABSTRACT

An abrasive suspension eroding system has an eroding unit (11), which can be lowered into an existing drilled hole (1), in order to generate a high-pressure erosion jet for the abrasive suspension eroding of material (6, 20) in an existing drilled hole (1). The eroding unit (11) can be connected to a drilling fluid line (9) and is configured to generate a high-pressure erosion jet from a drilling fluid abrasive suspension device.

20 Claims, 10 Drawing Sheets

ABRASIVE SUSPENSION ERODING SYSTEM

CROSS REFERENCE TO RELATED APPLICATIONS

This application is a United States National Phase Application of International Application PCT/EP2017/062751, filed May 26, 2017, the entire contents of which are incorporated herein by reference.

TECHNICAL FIELD

The present disclosure relates to an abrasive suspension eroding system for the abrasive suspension eroding of a material, for example of a rock or a pipe element, in an existing borehole, to a borehole facility with such an abrasive suspension eroding system and to a method for the abrasive suspension eroding of a material in an existing borehole.

TECHNICAL BACKGROUND

The abrasive suspension eroding system which is disclosed herein is applied for example in existing bores for hydrocarbon-based fossil energy sources such as oil or natural gas, in particular with regard to deep-sea bores, but also bores on land. After an exploitation of an energy source reservoir, specifically an existing bore must be reliably closed at a deep as possible point for the protection of the environment. Herein, the wells usually remain in the bore. The problem on closing the bore is often the fact that the wells laterally displace to one another or are pressed inwards and thus form a blockage, due to tectonic shifts and/or the lowering of the seabed (in particular with slanted and horizontal drill sections) due to the drilling. In order to prevent a leakage of oil or natural gas due to such damage to the well wall, a concrete plug must be placed distally of such damage. However, such damage also entails a blockage or narrowing of the well diameter, so that a section distally of such damage can no longer be reached by conventional tools for placing a concrete plug.

Common drill heads for milling/cutting open the well diameter at the location of damage, given bent wells or ones which are offset to one another, are deflected laterally out of their feed direction and bind. Such bound drill heads or tools which are inadvertently located in the well for other reasons, for instance seized packers, likewise represent a blockage and narrow or block the well, which in professional circles is denoted as a "fish". The removal of a fish is called "fishing".

Furthermore, a so-called drilling rig is necessary for the drilling and cutting with a drilling head. A drilling rig is a very large and costly construction on a drilling platform or drilling barge and is configured to carry out the actual borehole drilling and the placing of the wells. For this reason, is basically uneconomical to use such a large and costly construction to drill free existing wells, in order to then be able to close these.

SUMMARY

The use of the abrasive suspension eroding system according to the invention disclosed herein, for removing a blockage or for fishing by way of abrasive suspension eroding, compared to common drilling heads on the one hand has the advantage that it is not influenced by way of wells which are bent or offset to one another, in the feed direction, nor does it bind. Furthermore, the abrasive suspension eroding system which is disclosed herein can also be used for radially eroding open wells, in order for example to ensure a radial anchoring of the plug. Concerning the abrasive suspension eroding system which is disclosed herein, for example a nozzle head which is described in WO 2015/124182 can be applied. On the other hand, what is particularly advantageous concerning the abrasive suspension eroding system which is disclosed herein is the fact that no expensive drilling rig is necessary, but a so-called coiled tubing system can be used. The coiled tubing system has a significantly smaller construction and significantly lower operating costs than a drilling rig. Concerning coiled tubing, a coiled steel tube, for example as drilling fluid conduit and/or for the removal of rock samples, is let down into an existing bore. The coiled tubing system can also be used on smaller barges or floating cranes and can therefore be applied more flexibly than a drilling rig. Although a torque transmission as is the case with a drilling rig is not possible via the coiled steel pipe in the case of coiled tubing, however this is indeed not necessary for the abrasive suspension eroding system which is disclosed herein.

According to a first aspect of the present disclosure, an abrasive suspension eroding system is provided, with an eroding unit which can be let down into an existing borehole, for producing a high-pressure erosion jet for the abrasive suspension eroding of material in an existing borehole, wherein the eroding unit is connectable to a drilling fluid conduit and is configured to produce a high-pressure erosion jet from a drilling fluid-abrasive agent suspension: It is not therefore necessary to lay a separate conduit for a water-abrasive agent suspension, but the abrasive suspension eroding system which is disclosed herein permits the use of the existing drilling fluid conduit of a coiled tubing system and the use of the drilling fluid as an abrasive agent carrier for the abrasive suspension eroding.

Drilling fluid, also called drilling mud, is a water-based or oil-based viscous liquid with particular characteristics which fulfill many functions on drilling for fossil energy sources, in order to efficiently convey drilled rock to the surface. For example, drilling fluid for this purpose can be structurally viscous or shear-thinning and/or thixotropic. Drilling fluid often has a greater density than water, for example by 1.5 fold or more. The system which is disclosed herein now appropriates such drilling fluid and gives it a further function, specifically as an abrasive agent carrier for the abrasive suspension eroding of material, for example in the form of a blockage, a narrowing or a well wall, by way of a high-pressure erosion jet consisting of a drilling fluid-abrasive agent suspension.

In particular, one or more outlet nozzles of the eroding unit can be adapted to the particular flow characteristics and/or to the density of the drilling fluid. For example, with a given inlet pressure, the diameter of the outlet nozzles of the eroding unit can be configured larger, for example by more than 50% or more compared to such outlet nozzles which are adapted to water-abrasive agent suspension operation, in order to achieve a necessary minimum exit speed. Alternatively or additionally, an additive can be added to the drilling fluid, said additive briefly rendering the drilling fluid less viscous for the abrasive suspension eroding.

In particular, the nozzle head of the eroding unit can comprise a single-piece face region which by way of openings forms the outlet nozzles which are therefore "integrated" therein. Due to the often high salt content in aggressive drilling fluid, it is indeed the nozzle head which is subjected to the danger of corrosion. On account of the integral design of the outlet nozzles in a carbide end-piece, which can comprise for example tungsten carbide on the surface, it is not only the exit nozzles but also the complete nozzle head which is much better protected from corrosion.

One or more high-pressure erosion jets of the eroding unit can exit the eroding unit at a high pressure of the drilling fluid-abrasive agent suspension of 100 to 2000 bar or more, preferably however in the pressure range of approx. 500-700 bar and erode a pressed-in or offset well, rock, a fish or any other blocking material, to the extent that a region which lies distally of the blockage can be reached with a tool for setting a plug. The high-pressure erosion jets can herein be directed radially obliquely outwards and rotate about a rotation axis, so that the erosion jets form a cone-surface-shaped eroding surface. Given a distal feed, this eroding surface can sweep a blockage or narrowing and advancingly erode this in accordance with the diameter of the cone-surface-shaped eroding surface. On eroding by way of the high-pressure erosion jets, the eroding unit is subjected to hardly any resistance-dependent or angle-dependent recoil or lateral deflection. One or more erosion jets can be directed radially outwards and the nozzle head can be rotated about a concentric or eccentric rotation axis, in order to laterally erode open a well.

Optionally, the system comprises an abrasive agent supply unit which is fluid-connectable to the eroding unit via the drilling fluid conduit and which is fluidically connectable to the drilling fluid conduit upstream of a drilling fluid high-pressure pump. Alternatively, the abrasive agent supply unit or an additional abrasive supply unit can also be fluid-connectable to the drilling fluid conduit downstream of a drilling fluid high-pressure pump, wherein this abrasive agent supply unit then preferably comprises a pressure tank which is fillable with an abrasive agent. In the case of an abrasive agent supply unit which is arranged exclusively downstream behind the drilling fluid high-pressure pump, the drilling fluid high-pressure pump is not subjected to wear by way of the abrasive agent. However, since the refilling of a high-pressure tank with abrasive is basically more complex than refilling in a low-pressure region, the upstream arrangement of the abrasive agent supply unit in front of the drilling fluid high-pressure pump is basically preferred.

Optionally, the abrasive supply unit can be arranged upstream of a drilling fluid high-pressure pump and downstream of a supply pump, wherein the supply pump accelerates the drilling fluid and the abrasive agent is sucked into the drilling fluid due to the accelerated drilling fluid whilst utilizing the Venturi effect. Alternatively or additionally to this, the abrasive agent by way of gravity or assisted by gravity can run from a refilling funnel into a mixing chamber where the abrasive agent is mixed into the drilling fluid. Alternatively or additionally, the abrasive agent can be actively conveyed and/or mixed into the drilling fluid by way of a conveying device such as a conveying screw.

Optionally, the eroding unit can comprise a distal nozzle head section and a proximal anchoring section, wherein the nozzle head section is movable distally relative to the anchoring section. Herein, "distally" is to mean a position which is "deeper" with regard to the borehole direction and "proximally" accordingly a position which is "higher" with respect to the borehole direction. "Distally" therefore means in feed direction and "proximally" counter to the feed direction. By way of the distal movability, a defined feed advance of the nozzle head section can be ensured over a limited stretch during the abrasive suspension eroding. For this, the eroding unit can comprise for example a spindle or piston drive which is preferably driven in a hydraulic manner via the drilling fluid. Additionally or alternatively to a hydraulic drive with drilling fluid as a hydraulic fluid, another hydraulic fluid can possibly also be used, wherein the eroding unit is supplied with hydraulic power via a hydraulic conduit which is led parallel to the drilling fluid conduit, or a drive by way of an electric motor is provided, with regard to which the electric motor is supplied with electrical current via a cable which is led parallel to the drilling fluid conduit.

Optionally, the anchoring section can be anchored in an existing borehole in the rock and/or in a pipe element by way of first lateral anchoring elements. Herewith, the eroding unit can be fixed against axial oscillation, jamming and twisting. The anchoring elements can comprise for example three or more radial projecting toggle levers or spindles which are distributed at the peripheral side and which are radially supported against the well or the rock. After an eroding step, the nozzle head section can possibly be proximally retracted again or, by way of the retracting of the nozzle head section, the proximal anchoring section is "pulled" distally to the nozzle head section when this is indeed not anchored.

Optionally, the system can comprise a control unit which is signal-connected to the eroding unit and by way of which an anchoring of the anchoring section and/or a distal moving of the nozzle head section relative to the anchoring section is controllable. Alternatively or additionally, a nozzle head of the eroding unit or the eroding unit itself can possibly be pivoted with respect to the longitudinal axis, in order to follow a curve in the well or to steer the eroding more greatly onto one side. Such a pivoting can be controllable by way of the control unit. Alternatively or additionally, the cone angle of a cone-shaped eroding surface which is defined by the alignment of the outlet nozzles can be controllable by way of an adjustable alignment of the outlet nozzles by way of the control unit. Alternatively or additionally, the control unit can influence or control the erosion jets by way of one or more apertures or the like. Alternatively or additionally, the control unit can control the feed advance of the nozzle head with respect to the eroding unit and/or the feed advance of the eroding unit itself.

Optionally, the nozzle head section can be anchored in an existing borehole in the rock and/or in a pipe element in a distally extended position relative to the anchoring section by way of two lateral anchoring elements. Herewith, the eroding unit can be anchored in an existing borehole in the rock and/or in a pipe element by way of the two lateral anchoring elements, if the first anchoring elements are not anchored and vice versa. On anchoring the distal nozzle head section by way of the two lateral anchoring elements, a retraction of the nozzle head section into the anchoring section leads to the anchoring section being pulled distally if indeed the first anchoring elements are not anchored. The eroding unit can move through the bore in the manner of a caterpillar on account of this. Alternatively or additionally, the eroding unit can comprise advance elements such as wheels, chains, crawler legs, worm rollers or the like, in order to ensure a controllable feed advance of the eroding unit. Given vertical or slanted bores, the intrinsic weight of the eroding unit together with the drilling fluid conduit and other accessories can be utilized for the feed advance (drive). The eroding unit can preferably be coupled at the proximal side to a tool guide with feed elements, said tool guide being present at the distal end of the drilling fluid conduit and normally guiding a drill head, so that the eroding unit is advanced by way of the tool guide.

Optionally, the nozzle head section can comprise a distal nozzle head and a proximal nozzle head base, wherein the nozzle head is rotatable relative to the nozzle head base about a rotation axis. This rotation axis can lie concentrically or eccentrically to the longitudinal axis of tie nozzle head. An eccentric rotation has the advantage that the nozzle head can be configured smaller and that there exists more space for the away-transport of drilling fluid, abrasive agent and eroded material. As already described previously, a cone-surface-shaped eroding surface can be produced with one or more oblique erosion jets, in order to advancingly erode all material which is located within a cross section which is defined by the base surface of the cone-surface shaped eroding surface.

Optionally, the eroding unit can comprise at least one first outwardly directed nozzle and at least one inwardly directed second nozzle, wherein the at least one inwardly directed second nozzle has a distance to the rotation axis of the nozzle head. "Inwardly/outwardly directed" here can mean that the erosion jet out of the nozzle intersects the rotation axis or runs skew to this.

The eroding unit can optionally comprise at least two first nozzles which are aligned at a different angle with respect to the rotation axis, and/or at least two second nozzles, of which at least one is aligned such that the erosion jet intersects the rotation axis, and/or at least one is aligned such that the erosion jet runs skewly to the rotation axis. In order to achieve a maximal erosion performance, it is advantageous for each erosion jet to run at a different angle with respect to the rotation axis and to compliment the respective cone-surface-shaped eroding surfaces such that a maximal volume removal rate is achieved.

According to a second aspect of this disclosure, a borehole facility with a drilling fluid conduit and with an abrasive suspension eroding system which is described above is provided, wherein the eroding unit is fluid-connected to the drilling fluid conduit. Herein, the abrasive suspension eroding system preferably comprises an abrasive agent supply unit which is fluid-connected to the eroding unit via the drilling fluid conduit and which is fluid-connected to the drilling fluid conduit upstream of the drilling fluid high-pressure pump. The borehole facility therefore apart from the abrasive suspension eroding system comprises the drilling fluid conduit and preferably also the drilling fluid high-pressure pump.

According to a third aspect of the present disclosure, a method for the abrasive-suspension eroding within an existing borehole is provided, with the steps:

- letting down an eroding unit into the existing borehole, wherein the eroding unit is fluid-connected to an abrasive agent supply unit via a drilling fluid conduit,
- feeding abrasive agent into the drilling fluid conduit by way of the abrasive agent supply unit,
- pumping a drilling fluid-abrasive agent suspension through the drilling fluid conduit to the eroding unit,
- producing a high-pressure erosion jet of the drilling fluid-abrasive agent suspension by way of the eroding unit, and
- eroding material in the existing borehole by way of the high-pressure erosion jet of the drilling fluid-abrasive agent suspension.

The method is preferably used with deep-sea bores for hydrocarbon-based fossil energy sources such as oil or natural gas if a well of a borehole is to be closed at a point which is not reachable with the necessary tool for closure on account of a blockage or narrowing. After the above steps and a successful erosion of the blockage or narrowing, a concrete plug can be set distally of this blockage or narrowing, in order to close the well for the reliable protection of the environment.

Optionally, the method further comprises a distal moving of a distal nozzle head section of the eroding unit relative to a proximal anchoring section of the eroding unit. Herewith, the nozzle head section can be moved distally in a defined manner during the eroding, in order to advancingly erode a certain volume. Herein, similarly to drilling with a drilled head, the eroded material as well as the abrasive agent which is used for eroding is floated or flushed to the surface by way of the drilling fluid.

The method can optionally comprise an anchoring of a proximal anchoring section by way of first lateral anchoring elements. Herewith, a defined position of the eroding unit can be kept during the eroding.

The method can optionally comprise an anchoring of a distal nozzle head section in a position which is extended distally relative to the anchoring section, by way of second lateral anchoring elements. Herewith, the anchoring section can be pulled distally to the nozzle head section in a following manner and a caterpillar-like advance realized.

Optionally, the method can comprise a controlling of the anchoring and/or of the distal moving by way of a control unit which is signal connected to the eroding unit. The control unit can be arranged above ground and control all functions of the eroding unit via an electrical, optical or hydraulic signal lead.

Optionally, the method can comprise a rotating of a distal nozzle head of the nozzle head section relative to a proximal nozzle head base of the nozzle head section about a rotation axis, wherein the rotation axis can run eccentrically or concentrically to the longitudinal axis of the nozzle head. As already described previously, a cone-surface-shaped eroding surface can thus be produced with one or more oblique erosion jets, in order to progressively erode any material which is located within a cross section which is defined by the base surface of the cone-surface-shaped eroding surface. An eccentric rotation of the nozzle head on the one hand has the advantage that the nozzle head, given the same sweep radius, can be configured smaller and on the other hand more space is present to the top for the away-transport of drilling fluid, abrasive agent and eroded material.

Optionally, the feeding of the abrasive agent into the drilling fluid conduit by way of the abrasive agent supply unit can take place upstream of a drilling fluid high-pressure pump. On account of this, one does not need to provide a pressure tank for feeding abrasive agent into the high-pressure region which lies downstream of the drilling fluid high-pressure pump, by which means a simple, continuous refilling of abrasive agent is rendered possible.

The disclosure is hereinafter explained in more detail by way of embodiment examples which are represented in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
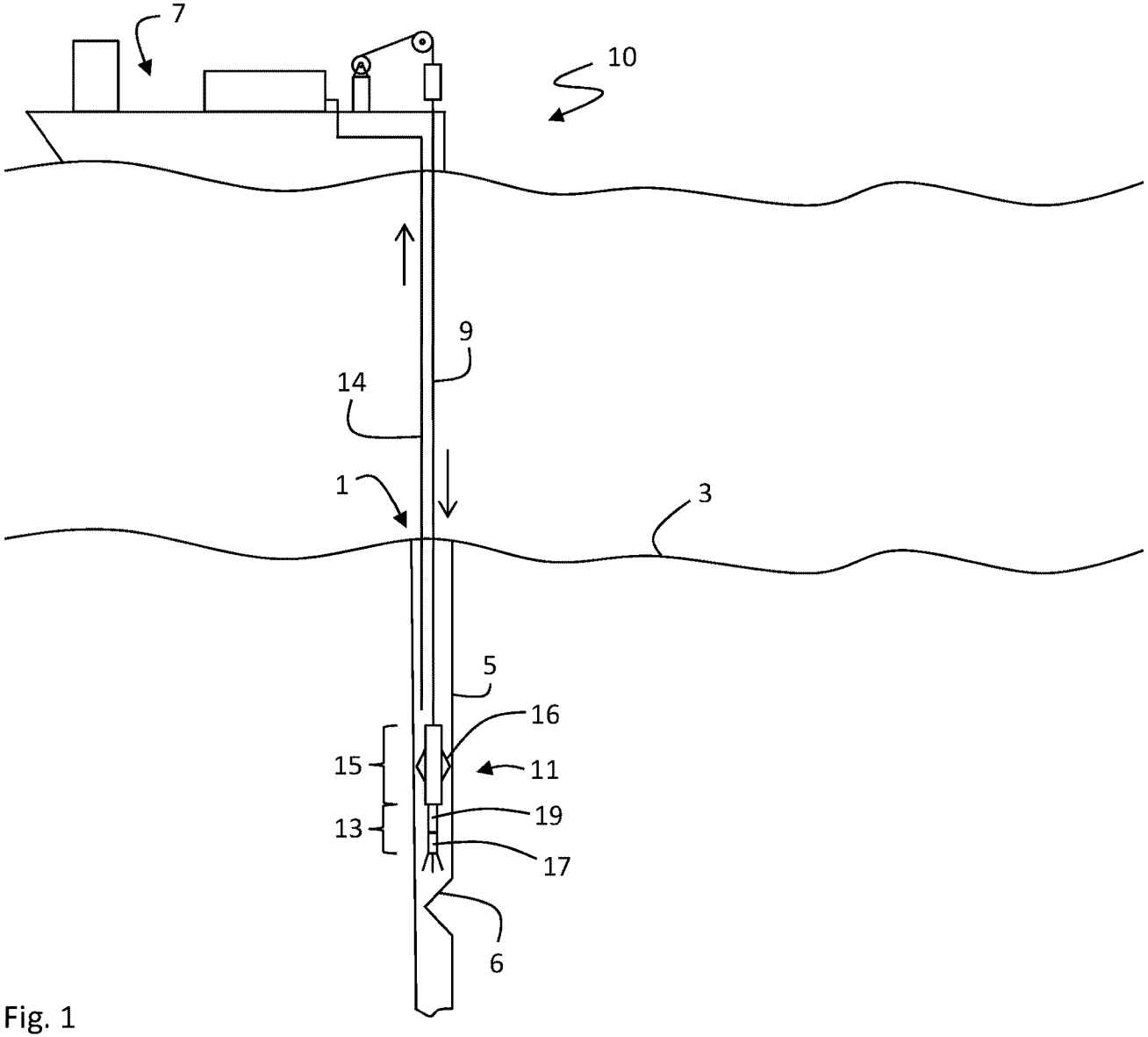
FIG. 1 is a schematic view of a first schematic application example of the abrasive suspension eroding system which is disclosed herein, for eroding a narrowing in a deep-sea bore.

Referring to the drawings, a deep-sea bore 1 in the sea bed 3 is shown in FIG. 1. The deep-sea bore 1 serves for drilling oil or natural gas and comprises wells 5 which are set on one another into a well, through which the oil or natural gas was brought to the surface. If the deep-sea bore 1 is no longer to be used for drilling for oil or natural gas, then it must be closed for the protection of the environment, so that oil or natural gas cannot flow through the deep-sea bore 1 into the sea. If however, as is shown here, at well 5 has become damaged or has been pressed in for example due to tectonic shifts or a lowering of the seabed inherent of the drilling for oil, then a plug must be placed below or distally of such a damage, in order to ensure that no oil or natural gas escapes due to the damage. The damage here is shown in the form of a narrowing 6. Here, it is to be noted that with regard to the deep-sea bore 1, it does not need necessarily need to be the case of a vertical bore, but the deep-sea bore 1 can also be slanted, horizontal and/or branched.

In order to now be able to place a plug below or distally of the narrowing 6, the cross section at the narrowing 6 must be opened to such an extent that a suitable tool for placing a plug passes through it. Conventional solutions with a drill cutting head however are often deflected laterally at such a narrowing 6 and bind. For this reason, here an abrasive suspension eroding system is used in combination with a drilling fluid conduit 9 of a borehole facility 10, wherein the drilling fluid conduit 9 is normally envisaged for efficiently conveying drilled rock to the surface on drilling with a drilling cutting head. The drilling fluid conduit 9 is brought into the deep-sea bore 1 via a platform 7 of the borehole facility 10, here in the form of a ship. An eroding unit 11 is fluid-connected to the drilling fluid conduit 9 at the distal end of the drilling fluid conduit 9. The eroding unit 11 is positioned in the deep-sea bore 1 within the well 5 directly above the narrowing 6. The eroding unit 11 is mechanically coupled to the drilling fluid conduit 9 in a manner such that the eroding unit 11 is positionable from the platform 7 by way of rolling in and rolling out the drilling fluid conduit 9. Herein, the intrinsic weight of the drilling fluid conduit 9 and of the eroding unit 11 can be used in the distal direction or an advance device can be provided, in particular for the advance given horizontal or relatively non-steep sections of the stretch.

The eroding unit 11 comprises a distal nozzle head section 13 and a proximal anchoring section 15. The anchoring section 15 can be anchored by way of lateral anchoring elements 16, here in the form of toggle levers. The nozzle head section 13 is extendable in the distal direction relative to the anchoring section 15. A nozzle head 17 which is rotatable relative to a nozzle head base 19 of the nozzle head section 17 is located at the distal end of the nozzle head section 13. Several outlet nozzles are arranged at a face side of the nozzle head 17. The outlet nozzles are arranged such that exiting erosion jets form a jet fan. On rotation of the nozzle head 17, each erosion jet which encloses an angle with the rotation axis R sweeps a cone-surface-shaped eroding surface. Concerning erosion jets which have a radially inwardly directed component and which intersect the rotation axis R or run skew to this, an eroding surface in the form of an outer surface of a rotation body of two cones or truncated cones which lie on one another with their tips results.

The borehole facility 10 further comprises a drilling fluid return 14, through which the drilling fluid together with the eroded material and the abrasive agent is flushed to the surface to the platform 7. The drilling fluid thus runs through a circuit, wherein the drilling fluid which is delivered to the surface is separated from the eroded material and abrasive agent on the platform 7 and is processed for reuse.

Figure 2:
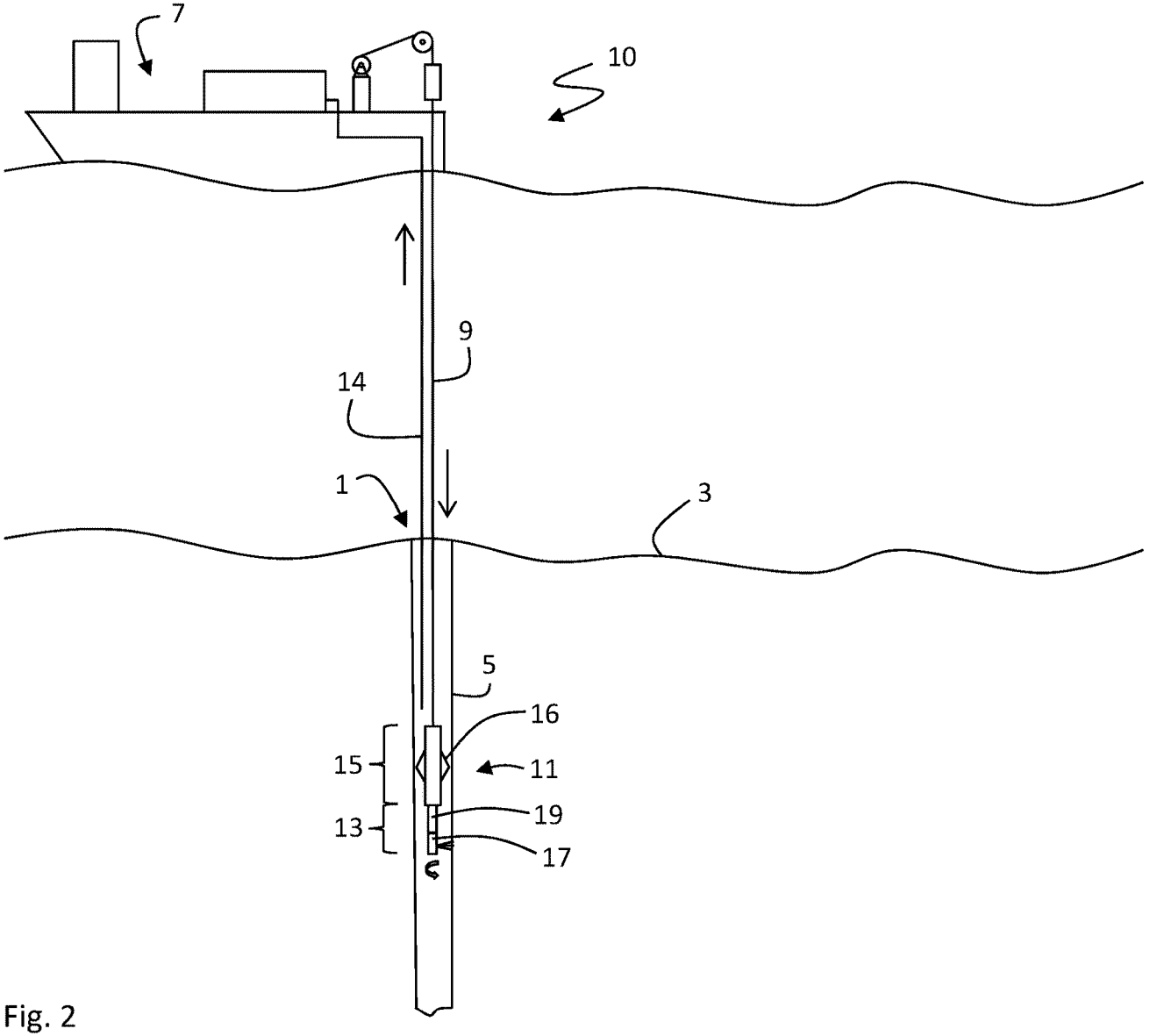
FIG. 2 is a schematic view of a second schematic application example of the abrasive suspension eroding system which is disclosed herein, for radially cutting open a well of a deep-sea bore.

In FIG. 2, another embodiment of a nozzle head 17 is used, in order to laterally erode open a well 5, in order to ensure that a concrete plug which is to be poured in at a later stage is anchored radially in the rock and that the well cannot be pressed upwards. One or more exit nozzles are directed radially outwards for the lateral eroding-open, so that a disc-like eroding surface which severs the well 5 at the peripheral side forms on rotation of the nozzle head 17.

Figure 3:
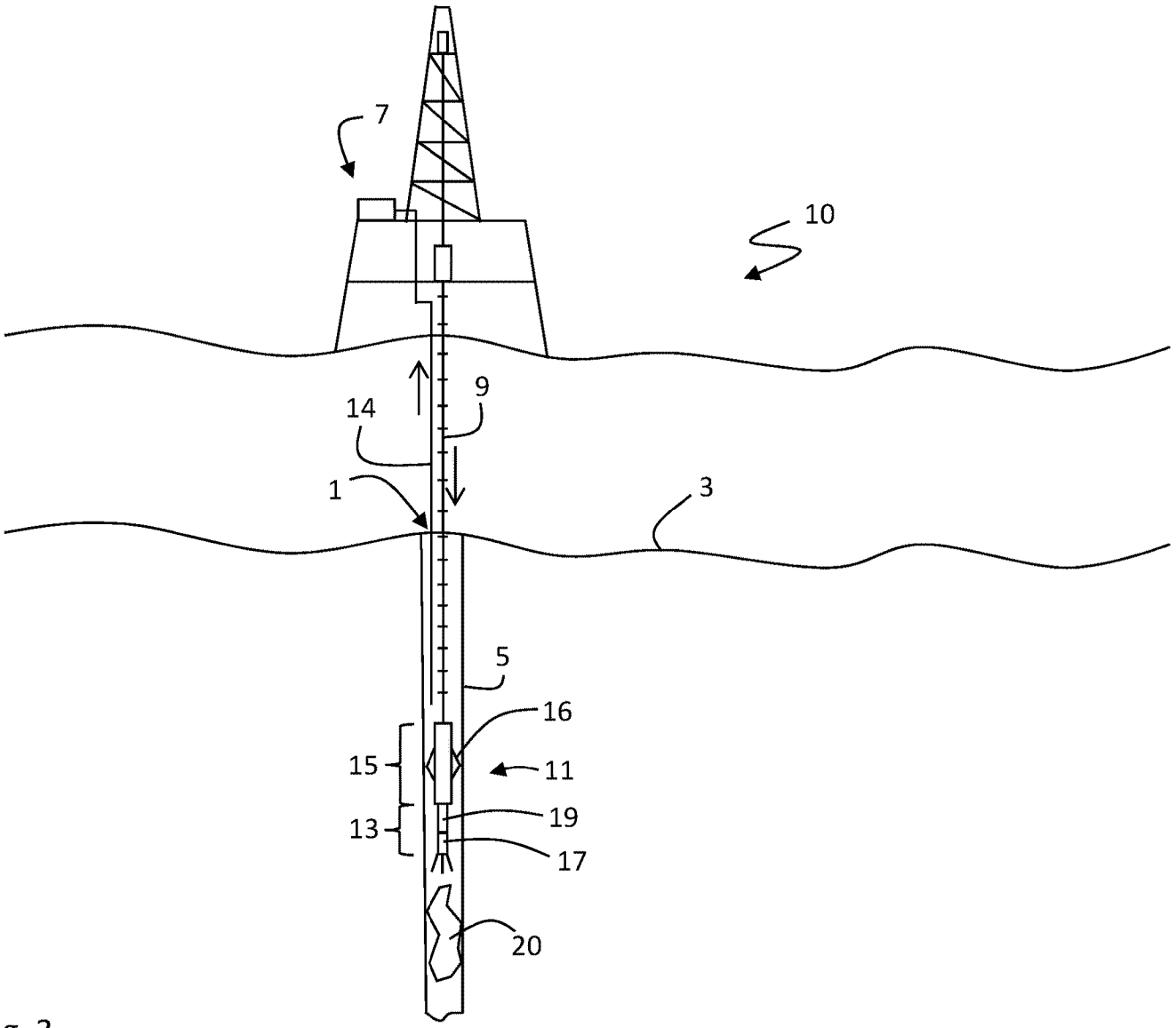
FIG. 3 is a schematic view of a third schematic application example of the abrasive suspension eroding system which is disclosed herein, for fishing in a deep-sea bore.

In FIG. 3, a fish 20 in the form of a packer is located in the well 5 and blocks this. Instead of applying a conventional method for fishing, the fish can be advancingly eroded by the eroding unit 11. The erosion jets, to which abrasive agent is added, given exist pressures of 500 or 700 bar can also erode very hard tool materials. Here, a derrick or a drilling rig is shown as a platform 7, in contrast to FIGS. 1 and 2.

Figure 4:
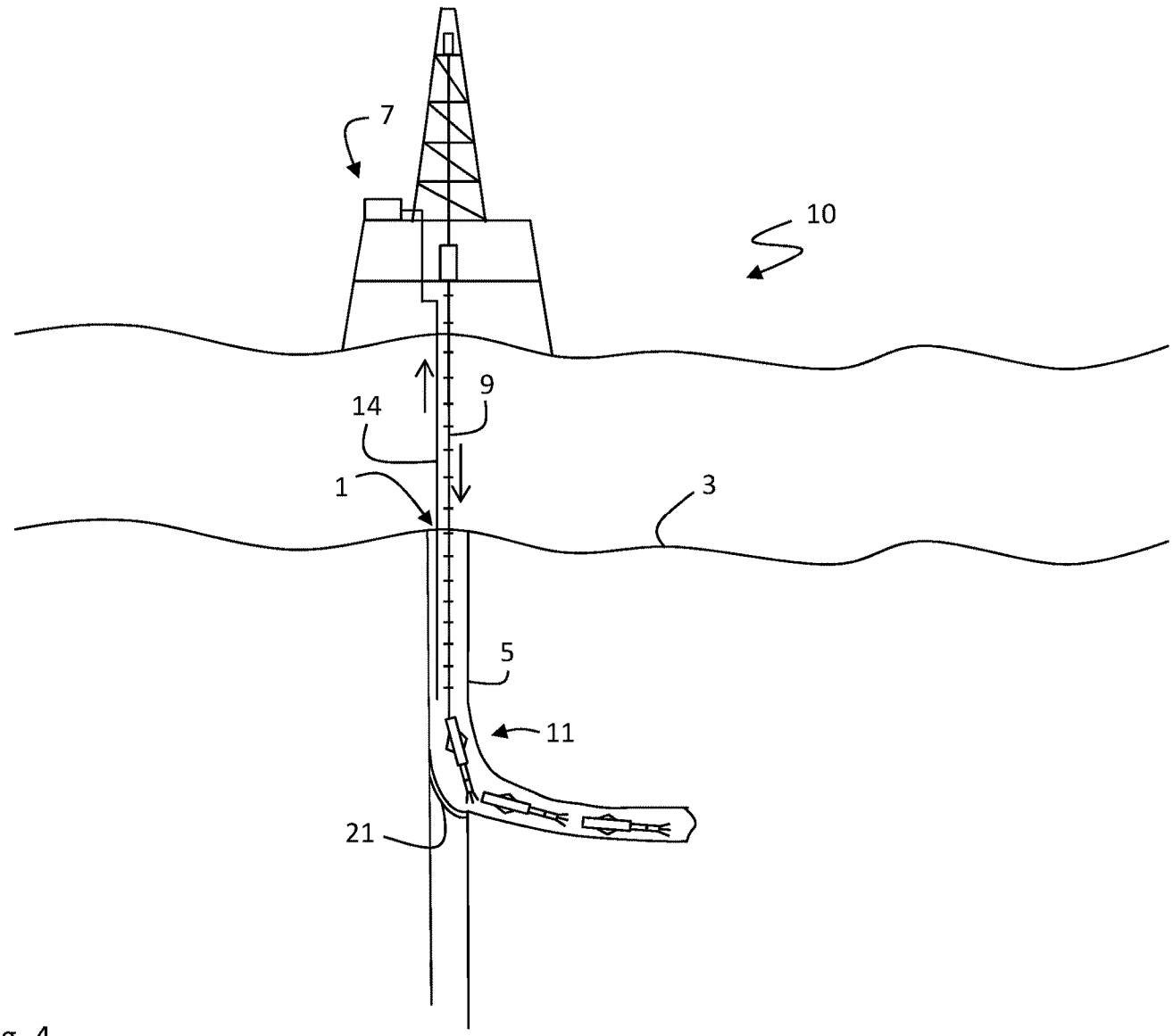
FIG. 4 is a schematic view of a fourth schematic application example of the abrasive suspension eroding system which is disclosed herein, for the lateral feed advance into a branching of a deep-sea bore.

With the embodiment in FIG. 4, a so-called side tracking is operated with the eroding unit 11. Herein, the eroding unit can be steered into a lateral branching and can be used there for eroding blockages or narrowings. The deflecting of the eroding unit 11 into the branching can hereby take place via a side-tracing guide 21. It is to be understood that the deflection takes place given switched-off eroding jets, so that the side tracking guide 21 is not advancingly eroded.

Figure 5:
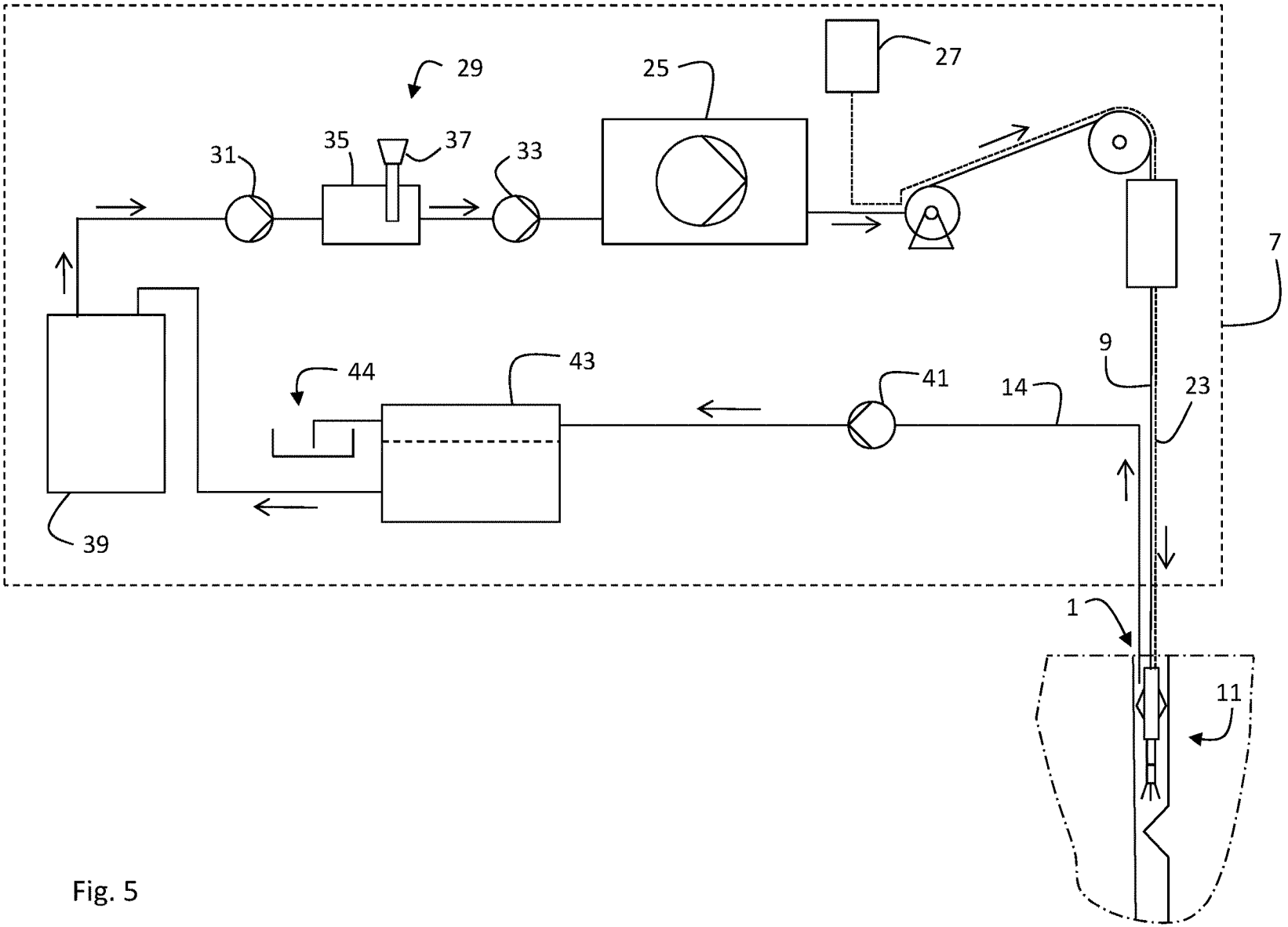
FIG. 5 is a schematic view of a first exemplary embodiment of a borehole facility with the abrasive suspension eroding system which is disclosed herein.

In FIG. 5, the circuit of the borehole facility 10 is shown schematically in more detail. The components which are located on the platform 7 are represented in dashed boxes. The eroding unit 11 which received into the existing borehole facility 1 is connected to the platform 7 via a drilling fluid conduit 9 and a signal lead 23. A drilling fluid high-pressure pump 25 which is arranged on the platform 7 pumps drilling fluid at a high pressure through the drilling fluid conduit 9 to the eroding unit 11. A control unit 27 is signal-connected to the eroding unit 11 via the signal lead 23 in order to switch, control, regulate, anchor and/or advance this. Herein, the signal lead 23 can be bidirectional, so that not only can the eroding unit 11 receive control commands but can also send signals of sensors, operating state variables, error notices, camera pictures or the like, to the control unit 27. For example, position or speed meters can measure the position of actuators for the anchoring elements 16, 53, the speed of the nozzle head 17 or the feed speed, temperature sensors control the temperature, acceleration sensors measure the spatial orientation, structure-borne sound or infrared sensors scan the environment or depth and inclination meters assist in the position evaluation. The obtained information can be displayed to the user by way of the control unit 27 or be used directly for the regulation and control of the operation of the eroding unit 11.

Abrasive agent is added to the drilling fluid, so as to be able to use the drilling fluid which is available to the eroding unit 11 at a high pressure of 500-700 bar via the drilling fluid conduit 9 for abrasive eroding. In the embodiment which is shown in FIG. 5, this takes place upstream which is to say at the suction side of the drilling fluid high-pressure pump 25. For this an abrasive agent supply unit 29 is arranged upstream of the drilling fluid high-pressure pump 25 between a supply pump 31 and a booster pump 33. The abrasive agent supply unit 29 comprises a mixing chamber 35 and a refilling funnel 37, wherein abrasive agent can be filled into the refilling funnel 37 in a manual or automatic manner and can run into the mixing chamber 35 which is arranged therebelow. This can take its course in a manner exclusively on account of gravity or only assisted by gravity. Alternatively or additionally, a conveying screw or the like can be used for leading abrasive agent in a defined abrasive agent flow into the mixing chamber 35 in a controlled manner. Alternatively or additionally, the drilling fluid flow which is produced by the supply pump 31 and the booster pump 33 can also be used for sucking the abrasive agent by way of the Venturi effect in the context of a mixing chamber 35 which functions as a jet pump. The abrasive agent is mixed with the drilling fluid within the mixing chamber 35 and downstream of the mixing chamber 35 forms a drilling fluid-abrasive agent suspension which is suitable for abrasive eroding. Here for example granite sand is a possible abrasive agent. The mixing ratio between the abrasive agent and the drilling fluid in the drilling fluid-abrasive agent suspension which is suitable for abrasive eroding can lie at about 1:9 and can be adjustable depending on the cutting performance requirements or can be set for a certain application purpose. At the suction side, the supply pump 31 is connected to a drilling fluid tank 39, from which the supply pump 31 obtains the drilling fluid. The drilling fluid tank 39 in turn is filled by way of already used and recovered drilling fluid.

For this, the drilling fluid-abrasive agent suspension together with eroded material such as eroded rock or the material of a fish or of a well wall can brought to the surface by way of a suction pump 41 via the drilling fluid return 14 which is received in the borehole 1. The suction pump 41 can possibly also only assist an already existing pressure difference and/or one which is produced by the drilling fluid high-pressure pump 25, said pressure difference pressing the drilling sludge upwards. The drilling fluid which is brought to the surface is led into a processing module 43. The processing module 43 comprises a shaker or shale shaker which separates the drilling fluid from rock, so that the drilling fluid can be recycled and can be led from the processing module 43 into the drilling fluid tank 39. Here, the processing module 43 also comprises an abrasive agent separator 44, so that the abrasive agent can also be reused and possibly in a direct manner can be fed again in wet or moist form or after a drying, to the circuit via the refilling funnel 37. Additionally to the abrasive agent, an additive such as long-chained polymers can also be admixed via the mixing chamber. Such long-chained polymers can be water-soluble and can serve for improving the focusing of the erosion jets or of the abrasive agent which is contained therein, for increasing the exit speed and for reducing the wearing in high-pressure components.

Figure 6:
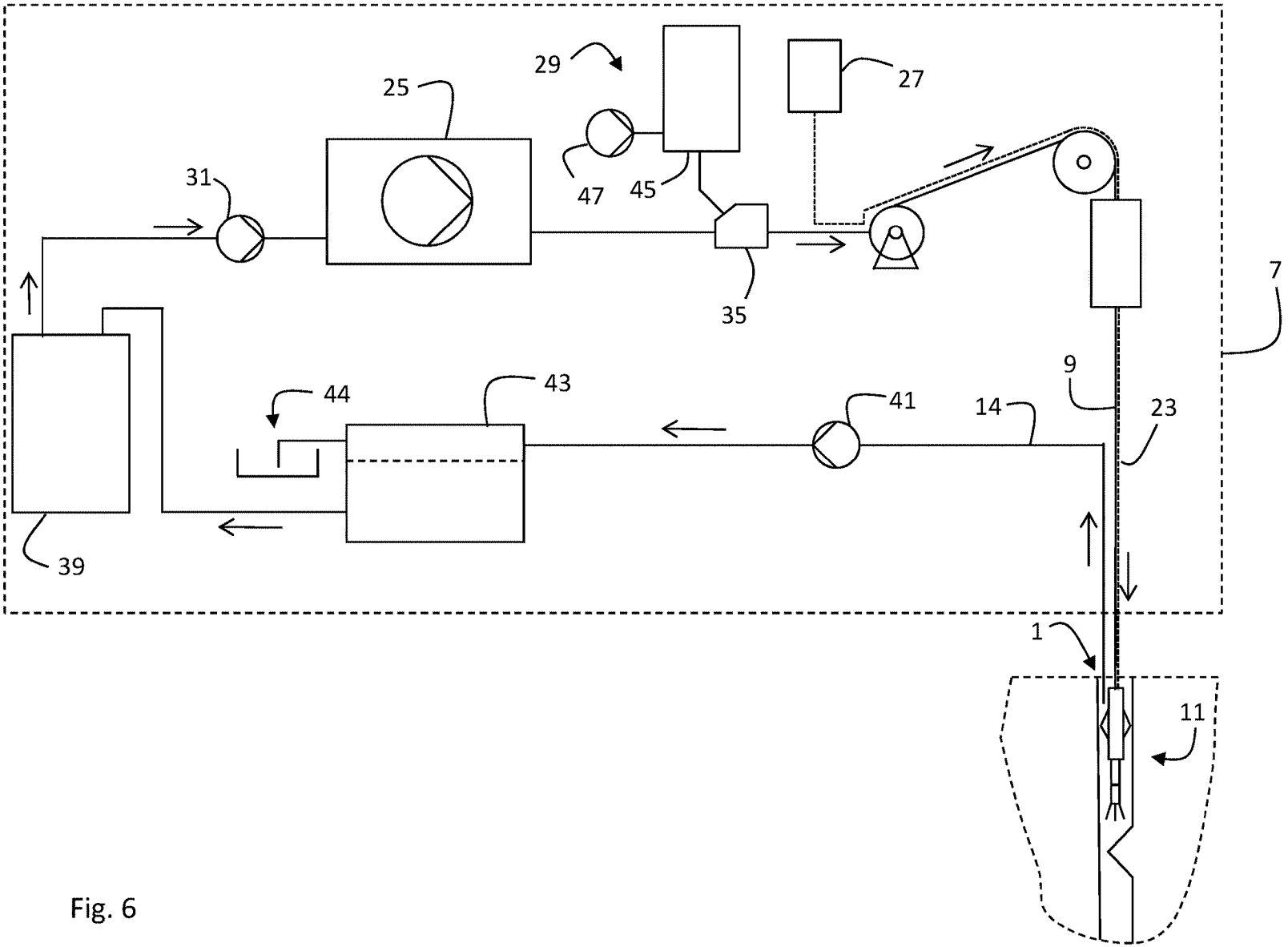
FIG. 6 is a schematic view of a second exemplary embodiment of a borehole facility with the abrasive suspension eroding system which is disclosed herein.

In the embodiment according to FIG. 6, the mixing chamber 35 of the abrasive agent supply unit 29 is arranged in the circuit downstream of the drilling fluid high-pressure pump 25. The abrasive agent supply unit 29 hereby comprises a pressure tank 45 and a high-pressure pump 47. The pressure tank 45 comprises an abrasive agent-water suspension or drilling fluid-abrasive agent suspension which by way of the high-pressure pump 25 is put under a pressure which is similar to that produced by the drilling fluid high-pressure pump 25. The abrasive agent as described beforehand is led and/or delivered into the mixing chamber 35, but now under high pressure. The pressure tank 45 can be configured such that a loading for the eroding is sufficient, so that the pressure tank 45 must firstly be relieved of pressure for a further eroding step, in order to fill it again for a new eroding step. Alternatively or additionally, the pressure tank 45 can also be filled cyclically and in an automatic manner via a lock system, so that a continuous operation without pressure relief is possible. Even if this embodiment is more complex than that which is shown in FIG. 5, here it is advantageous that the drilling fluid high-pressure pump 25 is not subjected to an increased wearing due to abrasive agent.

Figure 7:
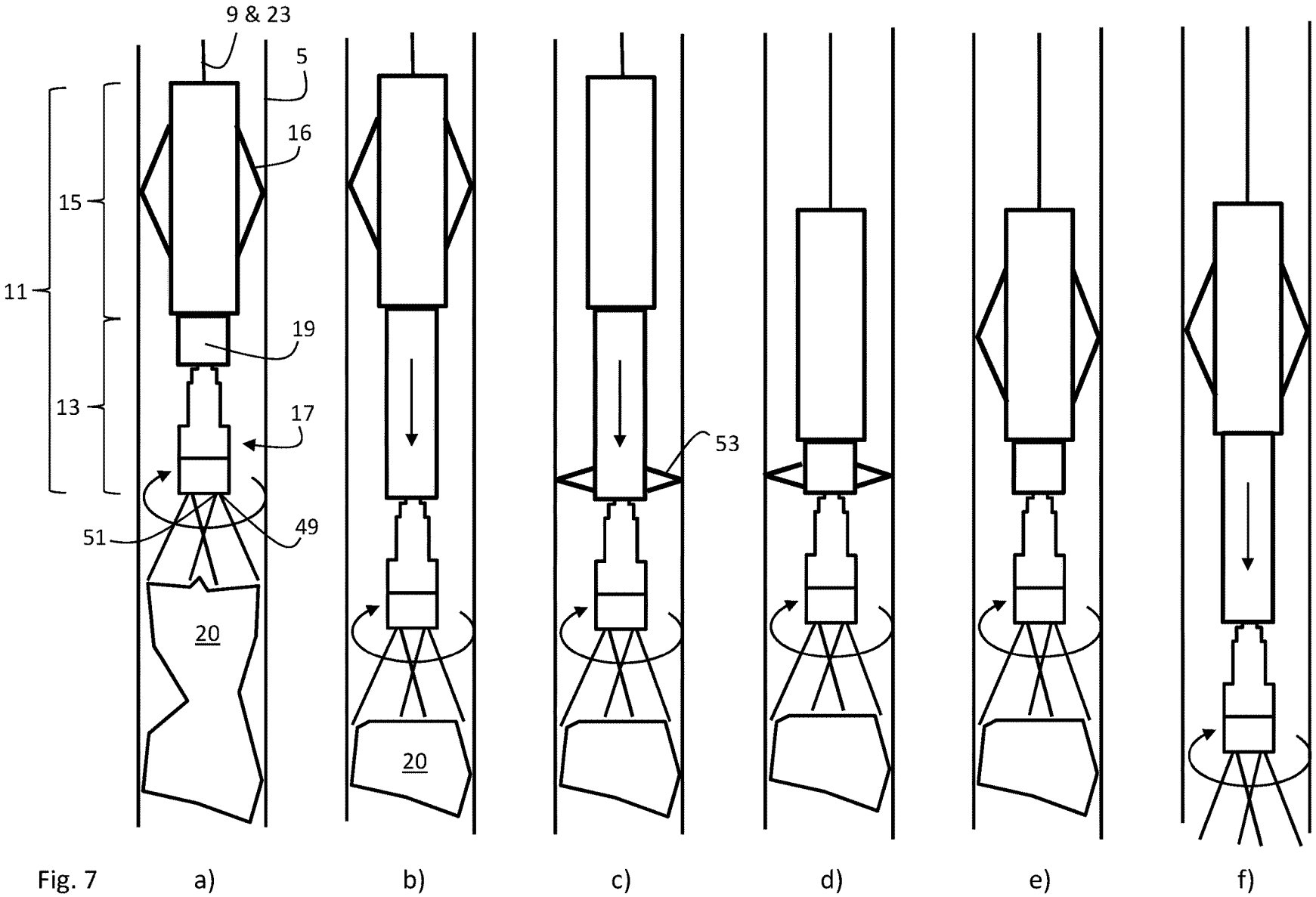
FIG. 7 is six momentary views a)-f) of an eroding unit of an exemplary embodiment of the abrasive suspension eroding system which is disclosed herein, in each case in different stages of the advance.

FIGS. 7*a*)-*f*) show an eroding unit 11 in a more detailed manner in different stages on eroding a fish 20. Firstly, in a), the eroding unit 11 is positioned in front of the fish 20, so that the erosion jets can advancingly erode the fish. 20. For this, the anchoring section 15, given a suitable axial position, is anchored laterally with first anchoring elements 16 in the form of toggle levers. The nozzle head 17 is rotated and the erosion jets of drilling fluid-abrasive agent suspension which exit out of the exit nozzles form cone-surface-shaped eroding surfaces which advancingly erode the material of the fish 20. For this, the nozzle head 17 at its distal face side comprises at least two nozzles with different alignments. A first nozzle 49 is herein aligned such that an erosion jet which is directly obliquely radially outwards is produced, and a second nozzle 51 is herein aligned such that an obliquely radially inwardly directed erosion jet is produced. The first nozzle 49 as well as the second nozzle 51 has a distance to the rotation axis R of the nozzle head 17. The cone-surface-shaped eroding surface which is produced by the first nozzle 49 has a proximal-side cone tip, whereas the cone-surface-shaped eroding surface which is produced by the second nozzle 51 has a distal-side cone tip. By way of this, given a distal advance of the first nozzle 49 and of the second nozzle 51, the erosion jets can erode once radially from the inside to the outside and once radially from the outside to the inside in a complementary manner and thus efficiently advancingly erode a volume.

On eroding, the nozzle head section 13 is extended distally relative to the anchored anchoring section 15 so that the cone-surface-shaped eroding surfaces sweep a volume of the fish 20, in order to hence advancingly erode this. In b), a maximal distal position of the nozzle head section 13 relative to the anchoring section 15 is reached, so that the rest of the fish 20 cannot be advancingly eroded if the eroding unit 11 is not advancingly driven. This can be effected via an advance device or, as is shown in c) and d), via second anchoring elements 53 which in the form of toggle levers are extended laterally out of the nozzle head section 13 and anchor the nozzle head section 13 in the well 5. The first anchoring elements 16 of the anchoring section 15 are retracted again. From c) to d), by way of retracting the anchored nozzle head section 13 into the anchoring section 15, one succeeds in the no longer anchored anchoring section 15 not pulling distally to the nozzle head section 13. The control unit 27 which controls all of this ensures a corresponding necessary feed of the drilling fluid conduit 9 and of the signal lead 23. In d), the nozzle head section 13 is then maximally retracted into the anchoring section 15, so that the second anchoring elements 53 can be retracted whist the first anchoring elements 16 can be extended again (see e)). In e), a further eroding step begins as in a) now for the remainder of the fish 20 at a deeper or more distal position. In f), the fish 20 has been completely advancingly eroded and the well section can be reached for placing the plug which lies below the (no longer existing) fish 20.

Figure 8:
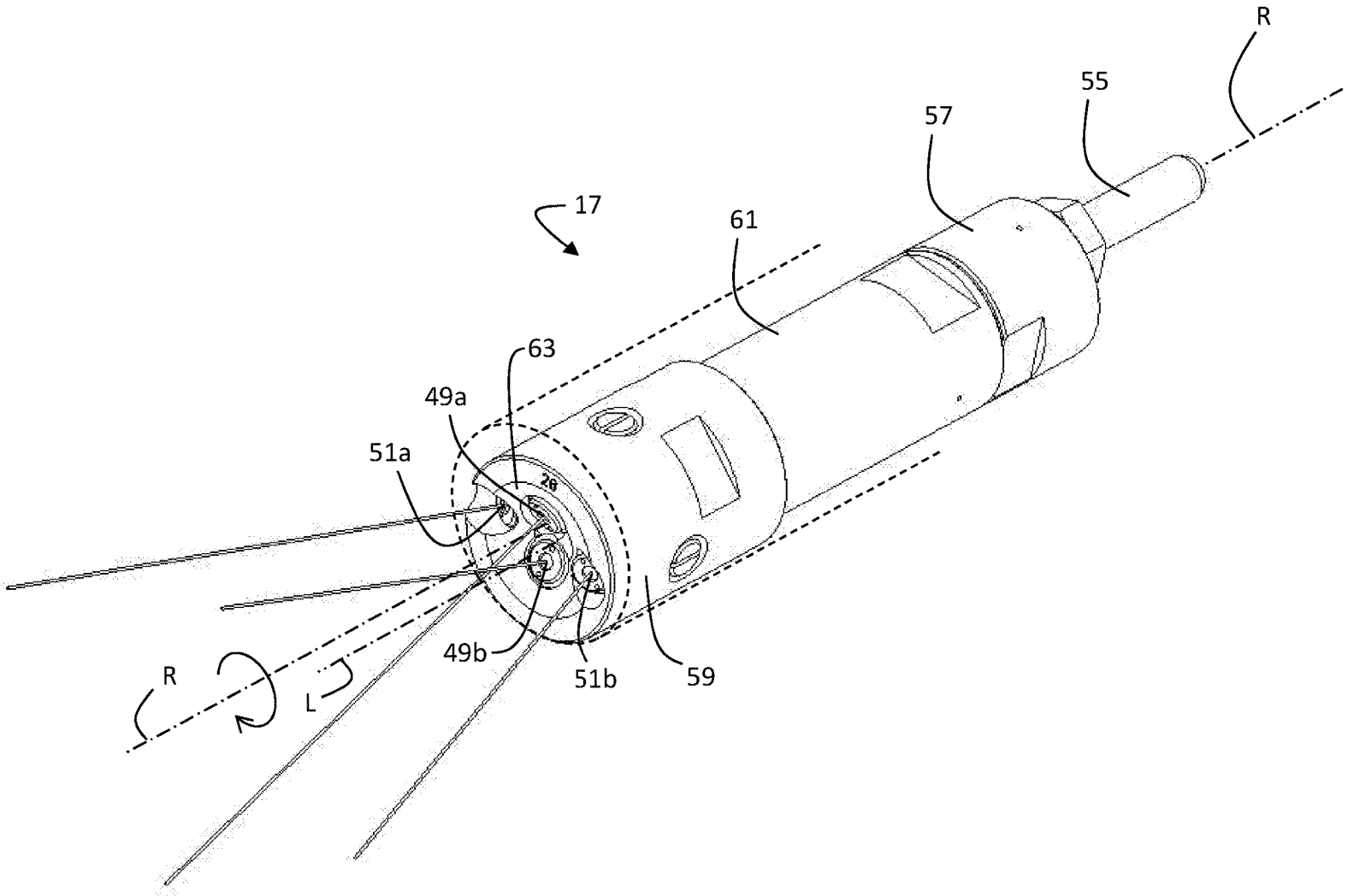
FIG. 8 is a perspective view of a nozzle head of an exemplary embodiment of the abrasive suspension eroding system which is disclosed herein.
Figure 10:
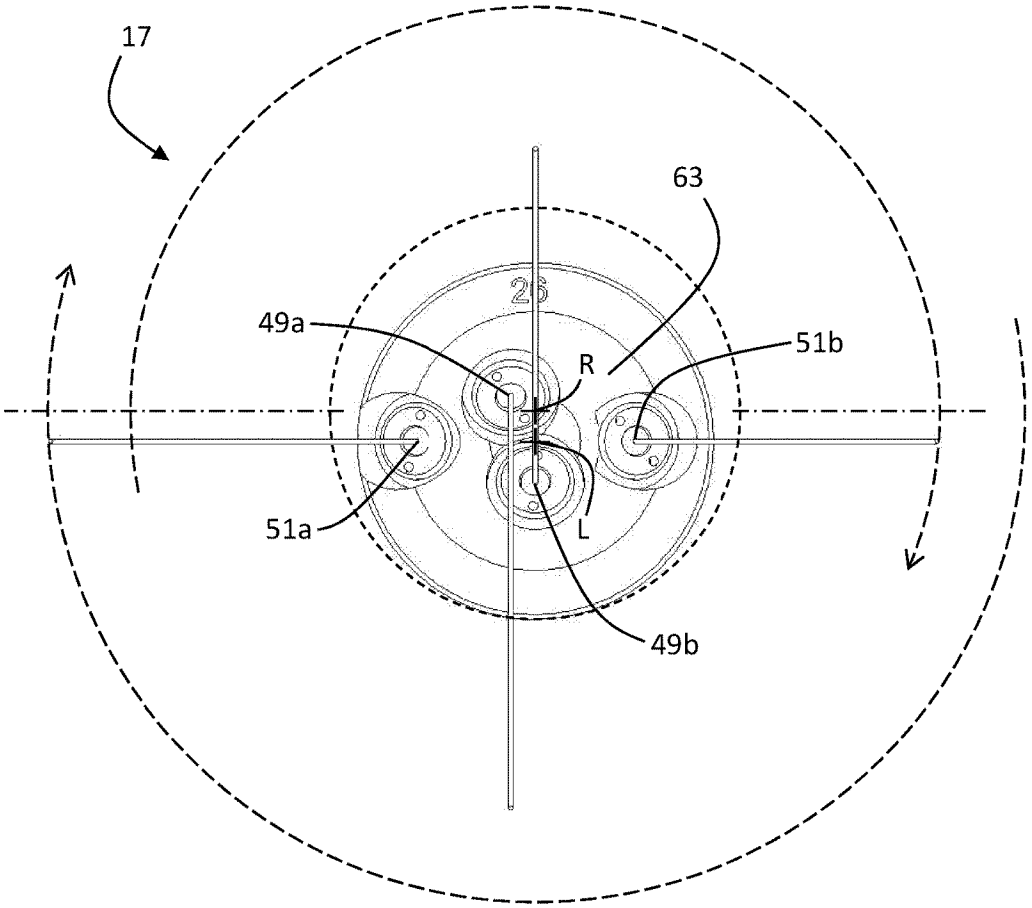
FIG. 10 is a view of the face side of a nozzle head of an exemplary embodiment of the abrasive suspension eroding system which is disclosed herein.
Figure 9:
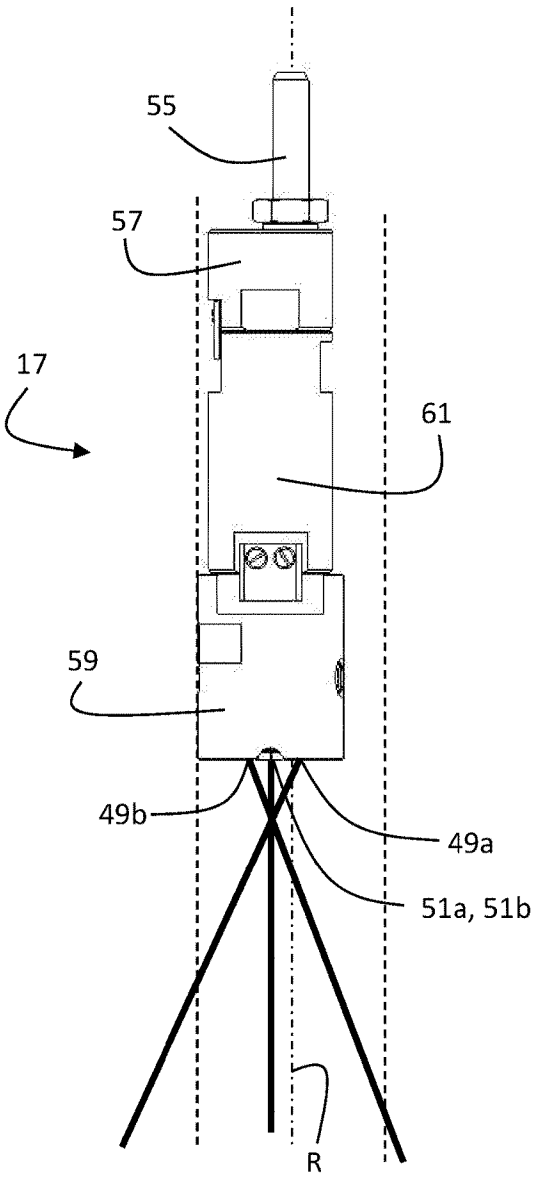
FIG. 9 is a lateral view of a nozzle head of an exemplary embodiment of the abrasive suspension eroding system which is disclosed herein.

FIGS. 8, 9 and 10 show the nozzle head 17 in more detail. At the proximal side, the nozzle head 17 is connectable to the nozzle head base 19 via a pipe connection 55. The pipe connection 55 is arranged concentrically to the rotation axis R and forms the feed of drilling fluid-abrasive agent suspension out of the drilling fluid conduit 9 into the nozzle head 17. The nozzle head 17 is itself rotatable with respect to the pipe connection 55, wherein the longitudinal axis L of the nozzle head 17 is eccentrically offset with respect to the rotation axis R. The cylinder-shaped envelope which with respect to the radius of the nozzle head 17 is radially enlarged by this offset and which is swept by the nozzle head 17 on rotation about the rotation axis R is represented in a dashed manner. The nozzle head 17 comprises three sections. A proximal entry section 57, a distal head section 59 and a middle section 61 which connects the entry section 57 to the head section 59. The pipe connection 55 leads into a proximal face side of the entry section 57. A flow guidance element with a spiral-shaped flow channel which brings the drilling fluid-abrasive agent suspension into rotation is seated within the middle section 61. The nozzles 49, 51 are arranged at a distal, face side of the head section 59 which here is preferably provided with at least one concave deepening 63. In this embodiment, there are two inner (first) nozzles 49*a*, 49*b* which are aligned inwards, wherein the erosion jet from an inner nozzle 49*b* intersects the rotation axis and the erosion jet from the other inner nozzle 49*a* runs skew to the rotation axis R. Optionally or additionally, the erosion jets here run at a different angle with respect to the rotation axis R. Optionally or additionally, there are two outer (second) nozzles 51*a*, 51*b* which are aligned outwards and whose erosion jets likewise run at a different angle with respect to the rotation axis R. Optionally or additionally, a virtual connection line between the first inner nozzles 49*a*, 49*b* here does not run perpendicularly to a virtual connection line between the second outer nozzles 5*a*, 51*b* (see FIG. 10). Optionally or additionally, the virtual connection line between the first inner nozzles 49*a*, 49*b* here does not run through the longitudinal axis L of the nozzle head 17 and/or not through the rotation axis R. Optionally or additionally, the distances of the first inner nozzles 49*a*, 49*b* to the longitudinal axis L and/or to the rotation axis R are different in each case. In FIG. 10, it is illustrated by way of the dashed cycles with a different radius that different cone-surface-shaped eroding surfaces are swept by the respective erosions jets due to the specific alignment of the second outer nozzles 51*a*, 51*b*. In each case the erosion jets of the first two inner nozzles 51*a*, 51*b* sweep different cone-surface-shaped eroding surfaces.

Figure 11:
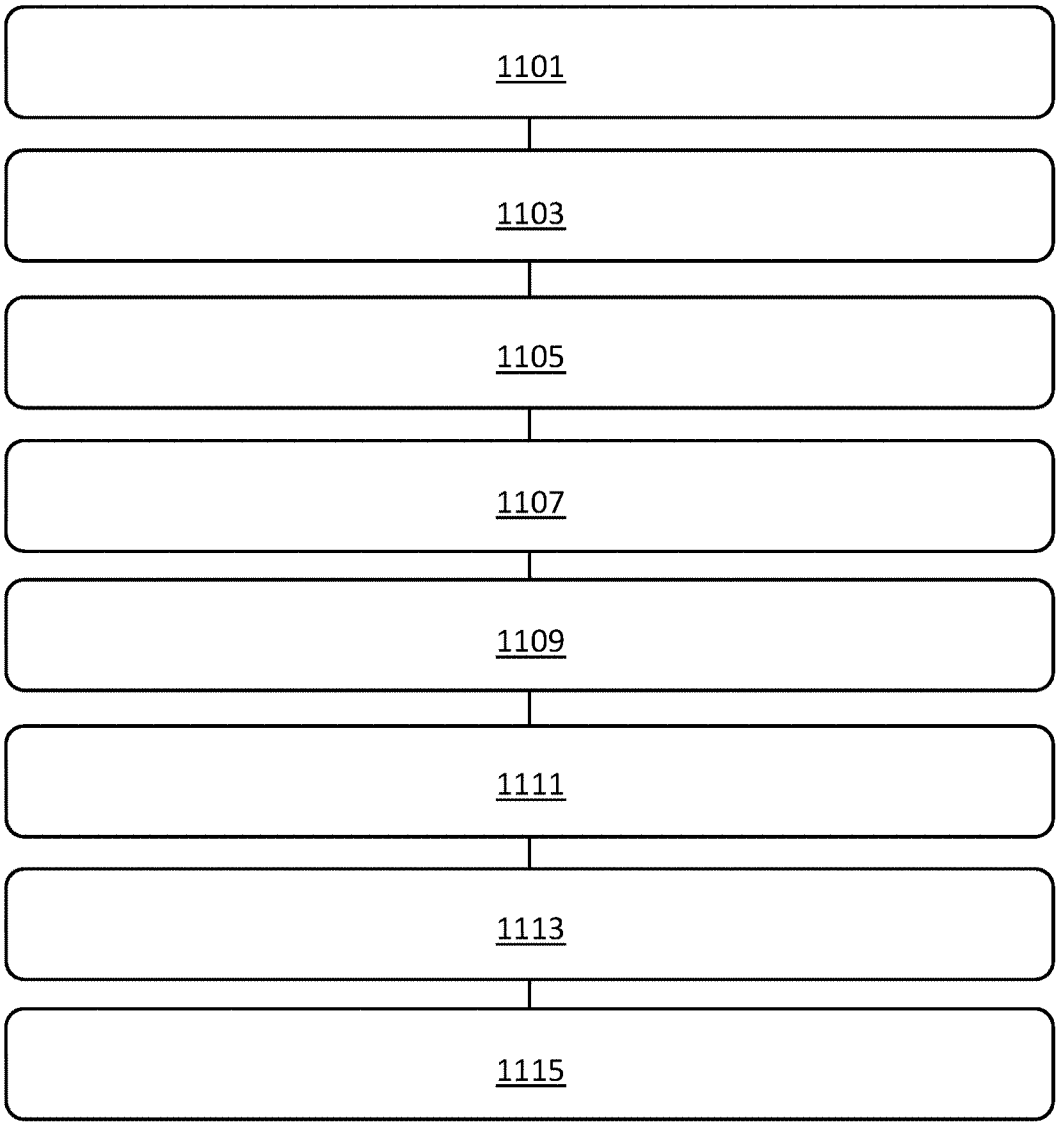
FIG. 11 is a procedural diagram of an exemplary embodiment of the method which is disclosed herein, for the abrasive suspension eroding of material within an existing borehole.

FIG. 11 schematically shows method steps as a flow diagram. Before, after or during a letting-down 1101 of an eroding unit into the existing borehole, abrasive agent is fed 1103 into the drilling fluid conduit by way of the abrasive agent supply unit, preferably upstream of the drilling fluid high-pressure pump 25. The drilling fluid-abrasive agent suspension which hence arises is pumped 1105 through the drilling fluid conduit to the eroding unit and a high-pressure erosion jet of the drilling fluid-abrasive agent suspension is produced 1107. Material in the existing borehole is then eroded 1109 by the thus produced high-pressure erosion jet. All method steps are preferably carried out in parallel. A distal moving 1111 of the nozzle head section 13 relative to the anchoring section 15, an anchoring 1113 of the anchoring section 15 and/or of the nozzle head section 13 and an eccentric rotating 1115 of the nozzle head 17 is preferably carried out parallel to the other method steps.

The numbered indications of the components or movement directions as "first", "second", "third" etc. have herein been selected purely randomly so as to differentiate the components or the movement directions amongst one another, and can also be selected in an arbitrarily different manner. Hence these entail no hierarchy of significance.

Equivalent embodiments of the parameters, components or functions which are described herein and which appear to be evident to a person skilled in the art in light of this description are encompassed herein as if they were explicitly described. Accordingly, the scope of the protection of the claims is also to include equivalent embodiments. Features which are indicated as optional, advantageous, preferred, desired or similarly denoted "can"-features are to be understood as optional and as not limiting the protective scope.

The described embodiments are to be understood as illustrative examples and no not represent an exhaustive list of possible alternatives. Every feature which has been disclosed within the framework of an embodiment can be used alone or in combination with one or more other features independently of the embodiment, in which the features have been described. Whilst at least one embodiment is described and shown herein, modifications and alternative embodiments which appear to be evident to a person skilled in the art in the light of this description are included by the protective scope of this disclosure. Furthermore the term "comprise" herein is neither to exclude additional further features or method steps, nor does "one" exclude a plurality.

While specific embodiments of the invention have been shown and described in detail to illustrate the application of the principles of the invention, it will be understood that the invention may be embodied otherwise without departing from such principles.

The invention claimed is:

1. An abrasive suspension eroding system comprising an eroding unit which can be let down into an existing borehole for producing a high-pressure erosion jet for the abrasive suspension eroding of material in the existing borehole, wherein the eroding unit is connectable to a drilling fluid conduit and is configured to produce a high-pressure erosion jet from a drilling fluid-abrasive agent suspension, the eroding unit comprising a distal nozzle head section and a proximal anchoring section, wherein the nozzle head section is distally movable relative to the anchoring section, the nozzle head section comprising a distal nozzle head and a proximal nozzle head base, wherein the nozzle head is rotatable relative to the nozzle head base about a rotation axis, the eroding unit comprising at least one first nozzle and at least one second nozzle, wherein the at least one first nozzle is aligned for producing an obliquely radially outwardly directed erosion jet and the at least one second nozzle for producing an obliquely radially inwardly directed erosion jet, wherein the at least one second nozzle has a distance to the rotation axis of the nozzle head.

2. An abrasive suspension eroding system according to claim 1, further comprising:

a drilling fluid high-pressure pump; and an abrasive agent supply unit which is fluid-connectable to the eroding unit via the drilling fluid conduit and which is fluidically connectable to the drilling fluid conduit upstream of the drilling fluid high-pressure pump.

3. An abrasive suspension eroding system according to claim 1, wherein the anchoring section comprises lateral anchoring elements and can be anchored in the existing borehole in rock and/or in a pipe element by way of the lateral anchoring elements.

4. An abrasive suspension eroding system according to claim 3, further comprising a control unit signal-connected to the eroding unit and by way of which an anchoring of the anchoring section and/or a distal moving of the nozzle head section relative to the anchoring section is controllable.

5. An abrasive suspension eroding system according to claim 3, wherein the nozzle head section can be anchored in the existing borehole in the rock and/or in the pipe element in a distally extended position relative to the anchoring section by additional lateral anchoring elements.

6. An abrasive suspension eroding system according to claim 1, wherein the nozzle head is eccentrically rotatable.

7. An abrasive suspension eroding system according to claim 1, wherein the eroding unit further comprises at least another first nozzle to provide at least two first nozzles which are aligned at a different angle with respect to the rotation axis, and/or wherein the eroding unit further comprises at least another second nozzle to provide at least two second nozzles, of which at least one is aligned such that the erosion jet intersects the rotation axis and/or at least one is aligned such that the erosion jet runs skewly to the rotation axis.

8. An abrasive suspension eroding system according to claim 1, further comprising:

a drilling fluid high-pressure pump; and an abrasive agent supply unit configured to deliver an abrasive agent to a drilling fluid to form the drilling fluid-abrasive agent suspension at a location outside of the eroding unit, wherein the drilling fluid-abrasive agent suspension is delivered to the drilling fluid conduit via at least the drilling fluid high-pressure pump.

9. An abrasive suspension eroding system according to claim 8, wherein the abrasive agent is delivered to the drilling fluid at a position upstream of the drilling fluid high-pressure pump with respect to a flow of the drilling fluid to form the drilling fluid-abrasive agent suspension.

10. An abrasive suspension eroding system according to claim 8, further comprising:

a drilling fluid supply pump configured to supply the drilling fluid to the abrasive agent supply unit, the abrasive agent supply unit being located between the drilling fluid high-pressure pump and the drilling fluid supply pump.

11. An abrasive suspension eroding system according to claim 1, further comprising:

a drilling fluid high-pressure pump; and an abrasive agent supply unit configured to deliver an abrasive agent to a drilling fluid at a position downstream of the drilling fluid high-pressure pump with respect to a flow of the drilling fluid to form the drilling fluid-abrasive agent suspension.

12. An abrasive suspension eroding system according to claim 11, further comprising:

a drilling fluid supply pump configured to supply the drilling fluid to the drilling fluid high-pressure pump, the abrasive agent supply unit being downstream of the drilling fluid high-pressure pump, wherein the drilling fluid high-pressure pump is located between the abrasive agent supply unit and the drilling fluid supply pump.

13. A borehole facility comprising:

a drilling fluid conduit; and an abrasive suspension eroding system comprising an eroding unit which can be let down into an existing borehole for producing a high-pressure erosion jet for an abrasive suspension eroding of material in the existing borehole, wherein the eroding unit is connectable to the drilling fluid conduit and is configured to produce a high-pressure erosion jet from a drilling fluid-abrasive agent suspension, wherein the eroding unit is fluid-connected to the drilling fluid conduit, the eroding unit comprising a distal nozzle head section and a proximal anchoring section, wherein the nozzle head section is distally movable relative to the anchoring section, the nozzle head section comprising a distal nozzle head and a proximal nozzle head base, wherein the nozzle head is rotatable relative to the nozzle head base about a rotation axis, the eroding unit comprising at least one first nozzle and at least one second nozzle, wherein the at least one first nozzle is aligned for producing an obliquely radially outwardly directed erosion jet and the at least one second nozzle for producing an obliquely radially inwardly directed erosion jet, wherein the at least one second nozzle has a distance to the rotation axis of the nozzle head.

14. A borehole facility according to claim 13, wherein the abrasive suspension eroding system further comprises a drilling fluid high-pressure pump and an abrasive agent supply unit which is fluid-connected to the eroding unit via the drilling fluid conduit and which is fluid-connected to the drilling fluid conduit upstream of the drilling fluid high-pressure pump.

15. A method for an abrasive-suspension eroding of material within an existing borehole, the method comprising the steps of:

letting down an eroding unit into the existing borehole, wherein the eroding unit is fluid-connected to an abrasive agent supply unit via a drilling fluid conduit, feeding abrasive agent into the drilling fluid conduit by way of the abrasive agent supply unit, pumping a drilling fluid-abrasive agent suspension through the drilling fluid conduit to the eroding unit by way of a drilling fluid high-pressure pump, producing a high-pressure erosion jet of the drilling fluid-abrasive agent suspension by way of the eroding unit, and eroding material in the existing borehole by way of the high-pressure erosion jet of the drilling fluid-abrasive agent suspension, wherein a distal nozzle head section of the eroding unit is distally moved relative to a proximal anchoring section of the eroding unit and a distal nozzle head of the nozzle head section is rotated relative to a proximal nozzle head base of the nozzle head section about a rotation axis, wherein an obliquely radially outwardly directed erosion jet is produced by at least one first nozzle of the nozzle head and an obliquely radially inwardly directed erosion jet is produced by at least one second nozzle of the nozzle head, wherein the at least one second nozzle has a distance to the rotation axis of the nozzle head.

16. A method according to claim 15, further comprising an anchoring of the proximal anchoring section by way of lateral anchoring elements.

17. A method according to claim 16, further comprising an anchoring of the distal nozzle head section in a position which is extended distally relative to the anchoring section, by way of additional lateral anchoring elements.

18. A method according to claim 15, further comprising a controlling of anchoring of the eroding unit and/or of the distal moving by way of a control unit which is signal-connected to the eroding unit.

19. A method according to claim 15, further comprising a rotating of the distal nozzle head of the nozzle head section relative to the proximal nozzle head base of the nozzle head section about a rotation axis which runs eccentrically to a longitudinal axis of the nozzle head.

20. A method according to claim 15, wherein the feeding of the abrasive agent into the drilling fluid conduit by way of the abrasive agent supply unit takes place upstream of the drilling fluid high-pressure pump.

* * * * *